United States Patent [19]

Dudley

[11] 4,065,118

[45] Dec. 27, 1977

[54] MONO-PAGE PAPER DISTRIBUTOR

[76] Inventor: George M. Dudley, 69 N. Boxwood St., Hampton, Va. 23365

[21] Appl. No.: 310,617

[22] Filed: Nov. 29, 1972

[51] Int. Cl.[2] ..... B65H 3/08; B65H 5/10

[52] U.S. Cl. ..... 271/14; 214/1 BT; 271/5; 271/20; 271/90

[58] Field of Search ..... 271/11–15, 271/20, 5, 90; 214/1 BT

[56] References Cited

U.S. PATENT DOCUMENTS

| | | | |
|---|---|---|---|
| 1,460,336 | 6/1923 | Hart | 271/20 |
| 1,578,822 | 3/1926 | Glover | 271/11 |
| 2,371,128 | 3/1945 | Costa | 214/1 BT |
| 2,912,240 | 11/1959 | Frankle et al. | 271/106 X |
| 3,501,138 | 3/1970 | McGee et al. | 271/11 |
| 3,578,312 | 5/1971 | Kocourek | 271/20 |
| 3,724,687 | 4/1973 | Marschke et al. | 271/11 X |

*Primary Examiner*—Bruce H. Stoner, Jr.
*Attorney, Agent, or Firm*—Howard J. Osborn; John R. Manning

[57] ABSTRACT

An improved apparatus for removing the top sheet from a stack of sheets and transporting it to a predetermined location includes a vacuum head for displacing and separating the sheet from the stack, a drive arrangement including a threaded shaft supporting the vacuum head for transporting the sheet to the predetermined location and control circuitry for regulating the cyclical operation of the apparatus.

6 Claims, 4 Drawing Figures

MONO-PAGE PAPER DISTRIBUTOR

ORIGIN OF THE INVENTION

The invention described herein was made by an employee of the National Aeronautics and Space Administration and may be manufactured and used by or for the Government for governmental purposes without the payment of any royalties thereon or therefor.

BACKGROUND OF THE DISCLOSURE

The invention relates generally to a paper mover and more specifically to an apparatus for removing single sheets of paper from a stack and depositing them at a designated location.

Much effort has been expended in the vocational rehabilitation of quadriplegics and studies have shown that quadriplegics can preform useful office-type functions at home working with data sheets and push-button office machines. The quadriplegic is able to transfer the information from the top of the stack into his office machine, but is physically incapable of removing the top sheet from the stack in order to gain access to the underlying sheets.

Accordingly, the development of an apparatus for removing the top sheet, and only the top sheet, from a stack of sheets has assumed great importance. While sheet-moving devices are known in the art, the separating and depositing system of the present invention is extremely simple in construction and operation, employs few and relatively inexpensive components, is essentially foolproof in operation, can be used in the home without outside accessories, is portable and can be easily operated by a quadriplegic.

Accordingly, it is an object of the present invention to provide an apparatus for removing single sheets of paper from a stack and depositing them at a predetermined location.

Another object of the present invention is to provide an apparatus for removing single sheets of paper from a stack containing different size sheets.

Another object of the present invention is to provide an apparatus for removing single sheets of paper from a stack wherein the sheets are not damaged and may be reused.

SUMMARY

In accordance with the principles of the present invention, a sheet-moving device is provided for separating a sheet from a stack of sheets, removing the sheet from the sheets therebelow and transporting the sheet to a predetermined location. When the mechanism is initially activated, an arm with an attached head moves along a motor-driven threaded shaft to the stack, such that the head engages the top sheet of the stack displacing it from the lower sheets. The arm trips a switch thereby reversing the drive motor and activating a vacuum pump having a hose connection in the head. The head picks the sheet up and the arm moves along the threaded shaft to a receiving tray. At the receiving tray, the arm trips a second switch reversing the drive motor and turning off the vacuum pump, causing the transported sheet to drop from the head into the receiving tray and the arm to move backward toward the stack. When the arm reaches a predetermined position between the receiving tray and the stack, it trips a third switch which shuts off the drive motor until it is activated for a subsequent sheet-moving cycle.

BRIEF DESCRIPTION OF THE DRAWINGS

The novel features which are considered as characteristic of the invention are set forth in particular in the appended claims. The improved sheet-moving device itself, however, both as to its construction and mode of operation, together with the additional features and advantages thereof, will be better understood upon examination of the following detailed description of a specific embodiment with reference to the accompanying drawing in which:

DETAILED DESCRIPTION OF THE INVENTION

Figure 1:
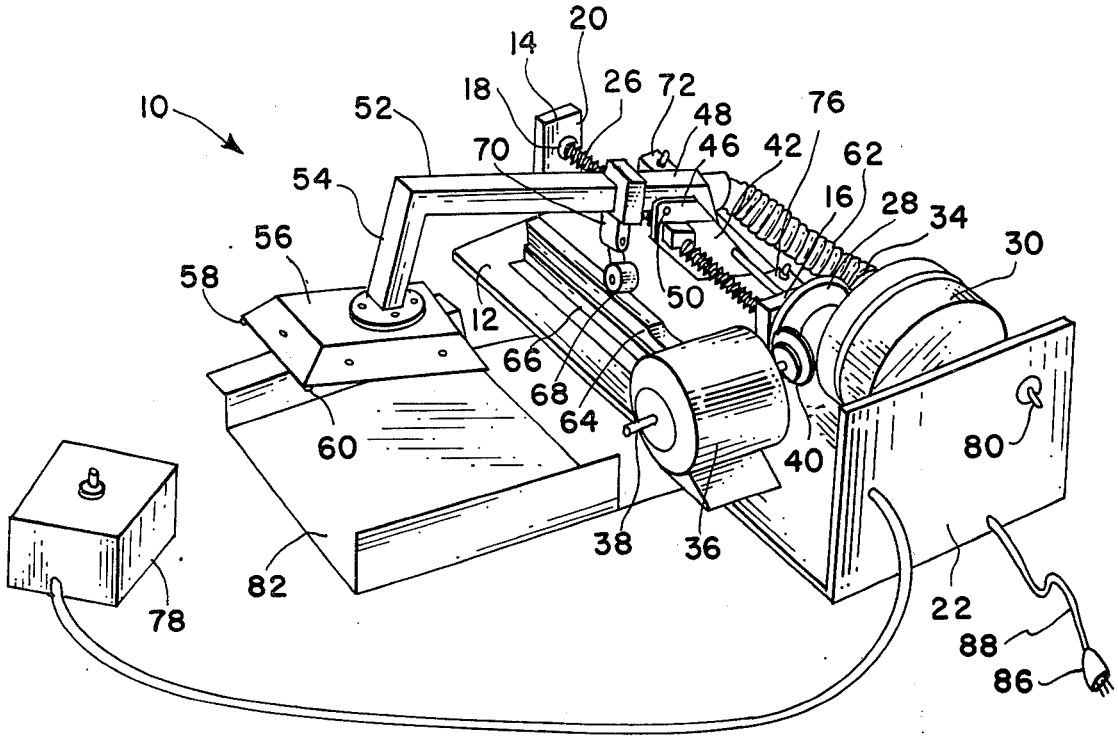
FIG. 1 is a perspective view of the improved sheet-moving device.
Figure 2:
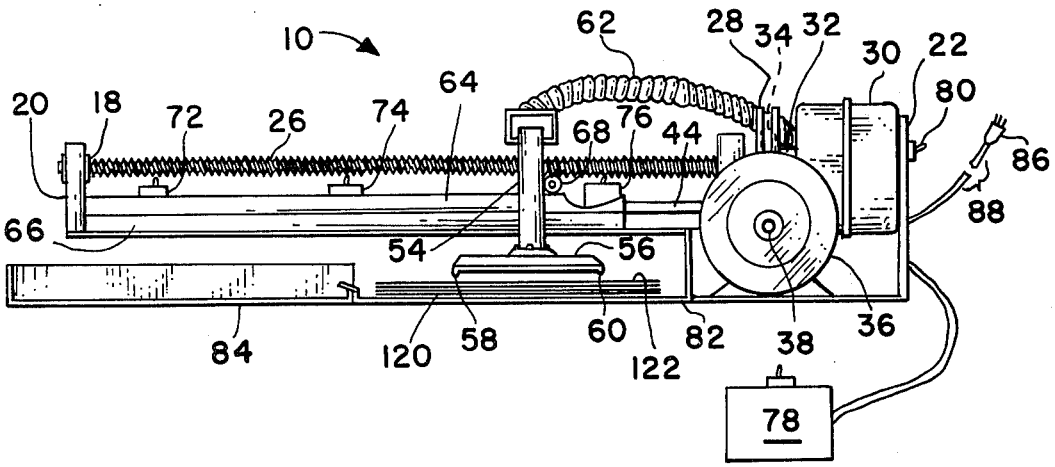
FIG. 2 is a front elevation of the improved sheet-moving device which embodies the present invention.
Figure 3:
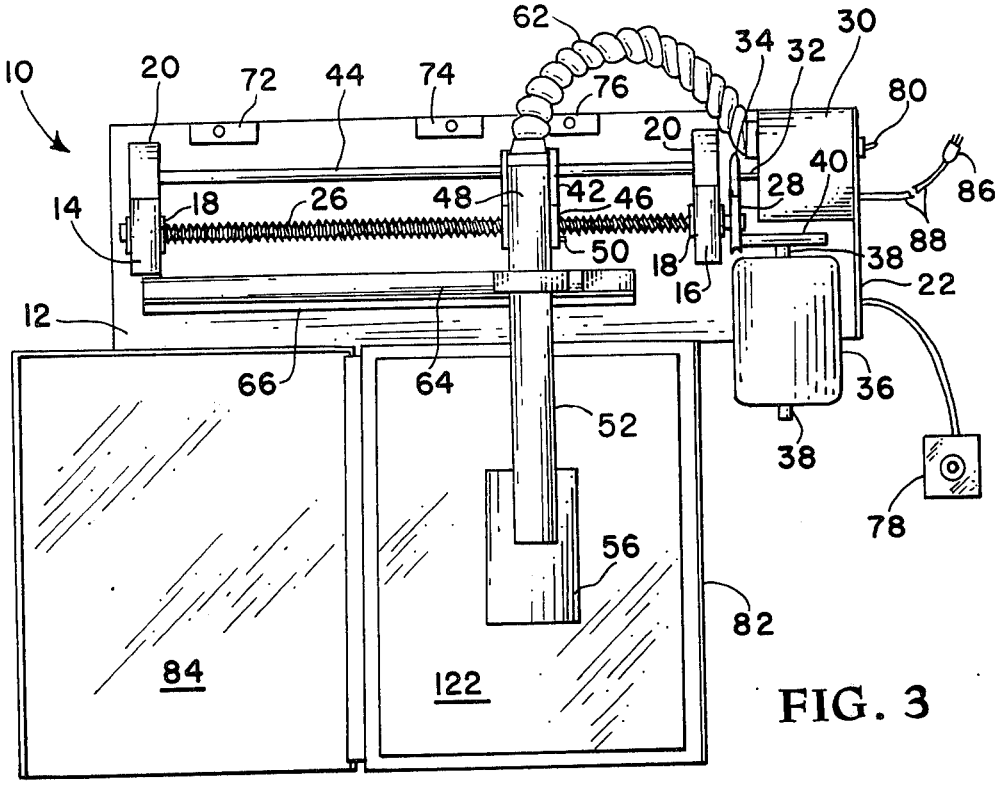
FIG. 3 is a top plan view of the improved sheet-moving device.

Referring now to the drawings, the sheet-moving device of the present invention is shown in FIGS. 1, 2 and 3 and is designated generally by reference numeral 10. Sheet-moving device 10 includes a flat base 12, first and second vertical blocks 14 and 16 mounted on base 12 and having shaft apertures 18 and rod mounts 20 formed horizontally therein and a vertical end piece 22 mounted on base 12. Shaft apertures 18 are fitted with sealed bearings, not shown in detail. A worm-threaded shaft 26 is journaled in the bearings in apertures 16 and 18. A drive disk 28, having a central aperture and circumferential edge groove formed therein is fixedly mounted onto the segment of threaded shaft 26 extending through block 16.

A vacuum pump 30, having a rotating shaft 32 onto which a rubber disk 34 is attached, is mounted on base 12 beside end piece 22 and facing drive disk 28 such that the circumferential surface of disk 34 engages and fits within the circumferential edge groove formed in drive disk 28.

A motor 36 having a rotating shaft 38 onto which a rubber disk 40 is fixedly mounted, is mounted on base 12 between drive disk 28 and end piece 22 such that the circumferential edge surface of disk 40 engages the flat side surface of drive disk 28. The mountings of both vacuum pump 30 and motor 36 are spring-loaded such that they are forced horizontally toward drive disk 28 such that there is a continuous frictional force between rubber drive disk 28 and disks 34 and 40.

A rectangular strut 42 is threadably mounted on threaded shaft 26, the base thereof being parallel with base 12. A restraining rod 44 (FIG. 3) parallel to threaded shaft 26, extends through an aperture formed in strut 42 near its base and is fixedly mounted at the ends in rod mounts 20 of blocks 14 and 16. A two-sided flange 46 is formed on the top of strut 42. A tubular shaped bracket 48 is pivotally mounted by pin 50 between the two sides of flange 46 such that the receiving end of bracket 48 projects away from restraining rod 44. A hollow-L-shaped arm 52 is in a sealed relationship with the receiving end of bracket 48 such that a leg 54 of arm 52 extends downward. A head 56, having rubber strips 58 and 60 on the underside thereof, is sealed to the end of leg 54. A conduit 62 connects vacuum pump 30 with bracket 48 such that arm 52 and head 54 are in fluid connection with vacuum pump 30.

A grooved guide template 64, mounted on a template holder 66 attached to base 12, is located under the end of bracket 48 and is parallel with threaded shaft 26. Wheel 68 is mounted on a swivel bracket 70 attached to the end of bracket 48 and engages the grooved surface of guide template 64.

Limit switches 72, 74 and 76 (FIG. 3) are mounted on base 12 parallel to and adjacent restraining rod 44 and are in electrical connection with motor 36. A command switch 78 removed from device 10 and a power switch 80 mounted on end piece 22 are also in electrical connection with motor 36.

A feed tray 82 and a receiving tray 84, having their adjacent sides in an overlapping relationship, are located parallel with threaded shaft 26 and under head 56. A dip is formed in template 64 adjacent to feed tray 82.

Figure 4:
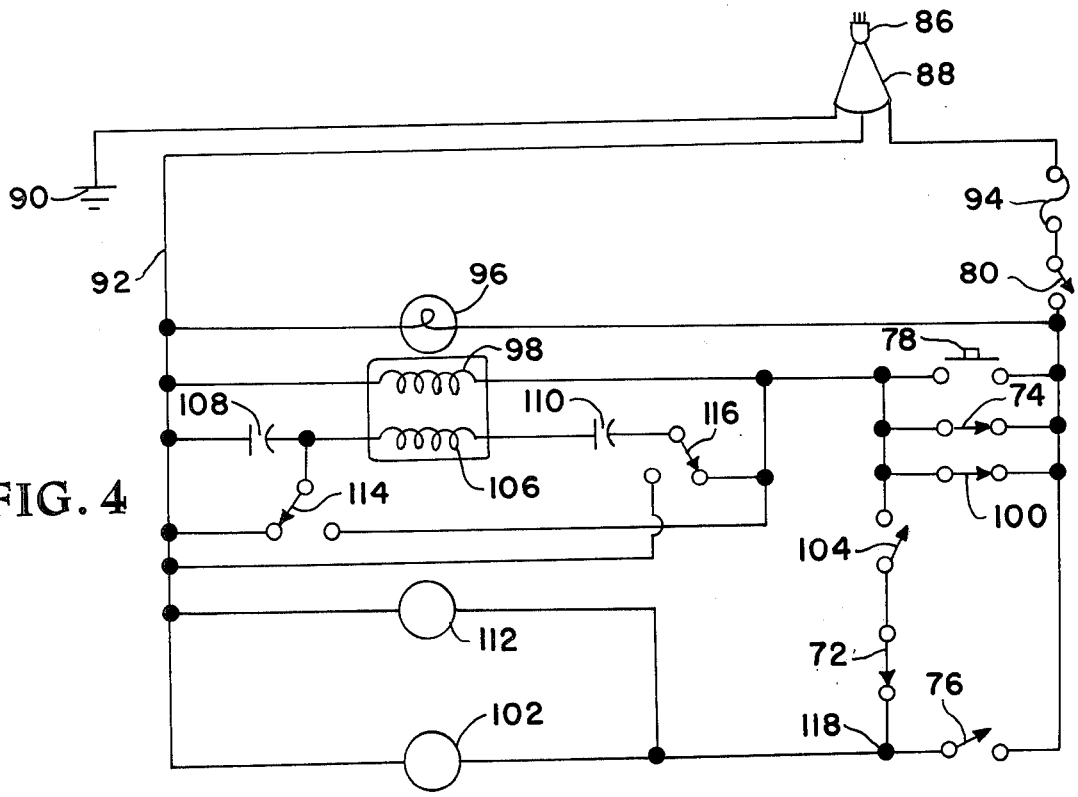
FIG. 4 is a schematic diagram of the electrical circuit of the present invention.

FIG. 4 shows the electrical circuit of the present invention wherein a power plug 86 is connected to a three-wire power cord 88 formed of a chassis ground wire 90, a ground buss wire 92 and a wire from fuse 94. Pilot light 96 is connected across power switch 80 and ground buss 92. Command switch 78 is in a series circuit with run coil 98 of drive motor 36 and is parallel by limit switch 74 and contact 100 of relay 102. Relay contact 104 and limit switches 72 and 76 form a series circuit which is in parallel with contact 100 relay 102. Run coil 98 of drive motor 36 is connected between ground buss 92 and command switch 78.

Start coil 106 of drive motor 36 and its associated capacitors 108 and 110 are in series with run coil 98 through contacts 114 and 116 of relay 112.

Relays 102 and 112 are in parallel and are connected between ground buss 92 and a common connection 118 of switches 72 and 65. A stack of sheets 120, having top sheet 122 thereon, is placed in feed tray 82.

OPERATION

Power switch 80 is turned on to provide power to the electrical circuit of sheet-moving device 10. Strut 42, mounted on threaded shaft 26, is initially positioned at limit switch 74 such that it holds limit switch 74 open and thereby opens the circuit to motor 36.

Command switch 78 is depressed and held, completing the motor circuit and causing motor shaft 38 and motor shaft disk 40 to rotate in the counterclockwise direction as viewed in FIG. 1. Motor shaft disk 40 sets drive disk 28 in motion counterclockwise such that threaded shaft 26 and vacuum pump shaft 32 rotate counterclockwise and clockwise, respectively. When vacuum pump shaft 32 rotates clockwise, vacuum pump 30 develops no suction force.

When threaded shaft 26 rotates in the counterclockwise direction, strut 42 moves thereon by worm gear operation toward feed tray 82. As strut 42 begins to move it releases limit switch 74 allowing it to complete the motor circuit and command switch 78 is not longer required to be depressed to close the circuit.

Arm 52 and guide wheel 68 move with strut 42 as it travels along threaded shaft 26 and guide wheel 68 rolls along the grooved surface formed in template 64. Strut 42 is prevented from rotating about threaded shaft 26 by restraining rod 44 extending therethrough. Pivotally mounted arm 52 and head 56 descend with guide wheel 68, as it negotiates the dip formed in template 64, at feed tray 82. Rubber strips 58 on the underside of head 56 engage top sheet 122 of stack 120 displacing it from the sheets below. The dipping motion of head 56 serves to separate sheet 122 from the sheets below and allows air to come therebetween. Rubber strips 58 and 60 both come into contact with separated sheet 122 such that a seal is formed between head 56 and sheet 122. Strut 42, continuing to move along threaded shaft 26, trips limited switch 76 which activates relays 102 and 112. Relay 102 serves to bypass limit switch 74 while relay 112 serves to reverse the power to start coil 106 of motor 36. Motor shaft 38 and motor shaft disk 40 begin to rotate in the clockwise direction as viewed in FIG. 1. Drive disk 28, vacuum pump shaft 32 and threaded shaft 26 all reverse their rotational directions such that strut 42 reverses its direction and moves toward receiving tray 84 and vacuum pump 30 develops a suction force. Conduit 60 transfers this suction force to arm 52 and thereby to head 56 which uses it to pick up top sheet 122.

As strut 42 moves in its new direction toward receiving tray 84, guide wheel 68 renegotiates the dip formed in template 64. Head 56 holding top sheet 122 and arm 52 follow guide wheel 68 according to the surface of template 64 and move with strut 42 toward receiving tray 84. On the way, strut 42 trips and opens limit switch 74, but relay 102 activated by the prior tripping of limit switch 76, serves to bypass switch 74 such that the motor circuit remains closed. At receiving tray 84, strut 42 trips limit switch 72 deactivating relays 102 and 112 such that motor 36 begins to rotate in its original direction and the bypass is removed from limit switch 74. Vacuum pump 30 ceases to develop a suction force and top sheet 122 drops from head 56 into receiving tray 84 therebelow.

Strut 42 begins to move along threaded shaft 26 toward feed tray 82. On the way strut 42 trips and opens limit switch 74 thereby opening the motor circuit. Motor 36 and threaded shaft 26 stop rotating and strut 42 continues to hold limit switch 74 open thereby opening the motor circuit until command switch 78 is depressed again. Each time command switch 78 is depressed strut 42 completes one paper-moving cycle and returns to open limit switch 74.

What is claimed as new and desired to be secured by Letters Patent of the United States is:

1. An improved device for removing the top sheet from a stack of sheets and transporting said top sheet to a predetermined location comprising:

a stack of sheets including a top sheet;

means for displacing said top sheet thereby separating said top sheet from said stack of sheets;

means for thereafter creating a vacuum, said vacuum means having suction head means associated with said sheet displacing means such that when said top sheet is in the displaced condition said suction means picks up and moves said top sheet from said stack of sheets;

means for transporting said sheet displacing means from said stack of sheets to a predetermined location and back to said stack of sheets; said means for transporting said sheet-displacing means toward and away from said stack of sheets being a rotating threaded shaft on which said sheet-displacing means is threadably mounted;

means for simultaneously controlling the operation of said vacuum means and said transporting means such that when said sheet-displacing means is at said stack of sheets said vacuum means operates and when said sheet displacing means is at said predetermined location, said vacuum means does not operate; and prime mover means for energizing said above-mentioned means.

2. The device as in claim 1 wherein said transporting means raises and lowers said sheet-displacing means by a guide wheel attached to said sheet displacing means riding on a guide template adjacent to said threaded shaft whereby said attached guide wheel traces the vertical contour formed in said guide template such that said sheet-displacing means moves according to said contour.

3. The device as in claim 1 wherein said controlling means are switches controlling the operation and rotational direction of said rotating threaded shaft and the operation of a vacuum pump as driven by said prime mover means wherein said switches coordinate the operation of said threaded shaft and said vacuum pump.

4. An improved device for removing the top sheet from a stack of sheets and transporting said top sheet to a predetermined location, comprising:

a stack of sheets including a top sheet;

a drive motor;

a vacuum pump connected to said drive motor, the operation and rotational direction thereof being controlled by the rotational direction of said drive motor;

a threaded shaft connected to said drive motor wherein the rotational direction of said threaded shaft corresponds to the rotational direction of said drive motor;

a threaded strut mounted on said threaded shaft such that said strut moves along said threaded shaft by screw thread action;

a hollow arm pivotally connected at one end to said threaded strut and connected at the other end to a vacuum head;

a hose connecting said vacuum pump to said one end of said hollow arm and thereby to said vacuum head;

a guide template having a vertical contour formed therein and adjacent to said threaded shaft;

a guide wheel attached to said arm wherein said wheel rolls along said guide template and follows said vertical contour formed therein such that said attached arm follows said vertical contour;

said vacuum head engaging said top sheet and displacing said top sheet, said vacuum head moving said top sheet until an air film is formed between said top sheet and the adjacent sheet thereafter enabling effective operation of said vacuum head and the pickup of a single sheet;

limit switches mounted adjacent said threaded shaft at said stack of sheets, at said predetermined location and between said stack of sheets and said predetermined location such that said arm moving along said threaded shaft trips said limit switches whereby said switches serve to reverse and control the rotational direction of said drive motor and said threaded shaft thereby controlling the movement of said arm along said threaded shaft and the operation of said vacuum pump;

a remote drive motor switch to initially activate said drive motor.

5. The device as in claim 4 wherein said vertical contour formed in said guide template is formed such that the height thereof is at least as high as said stack of sheets such that said vacuum head attached to said arm engages the bottommost sheet of said stack of sheets.

6. The device as in claim 4 wherein said vacuum pump is displaced from said sheet-moving device and is energized by said drive motor and controlled by said limit switches.

* * * * *